US005588388A

United States Patent [19]

Maruyama et al.

[11] Patent Number: 5,588,388

[45] Date of Patent: Dec. 31, 1996

[54] HULL SHAPE OF SMALL WATERCRAFT

[75] Inventors: Haruyoshi Maruyama, Kakogawa; Shin Ogata, Himeji; Yoshinori Tsumiyama, Miki, all of Japan

[73] Assignee: Kawasaki Jukogyo Kabushiki Kaisha, Hyogo, Japan

[21] Appl. No.: 483,313

[22] Filed: Jun. 7, 1995

[30] Foreign Application Priority Data

Oct. 3, 1994 [JP] Japan ..... 6-264503

[51] Int. Cl.[6] ..... B63B 1/00

[52] U.S. Cl. ..... 114/271; 114/270; 114/288

[58] Field of Search ..... 114/56, 271, 288, 114/291, 270

[56] References Cited

U.S. PATENT DOCUMENTS 4,224,889 9/1980 Spiegel ..... 114/291
5,351,642 10/1994 Ackerbloom ..... 114/291

FOREIGN PATENT DOCUMENTS 62-34897 2/1987 Japan .

*Primary Examiner*—Jesus D. Sotelo
*Attorney, Agent, or Firm*—Marshall, O'Toole, Gerstein, Murray & Borun

[57] ABSTRACT

A small watercraft hull is shaped to prevent spray from being splashed on occupants of a watercraft, to enhance the course stability of the craft during turning, and to reduce the resistance of the craft body 3 to the water. A longitudinal chine, extending in a longitudinal direction, and rearwardly curved transverse chines extending in transverse directions and located in the fore part of the craft body, are provided on a V-shaped hull bottom of the craft body, the transverse chines being so formed as to cross the forward part of the longitudinal chine or an imaginary line extended forwardly from the longitudinal chine.

13 Claims, 5 Drawing Sheets

FIG. 4
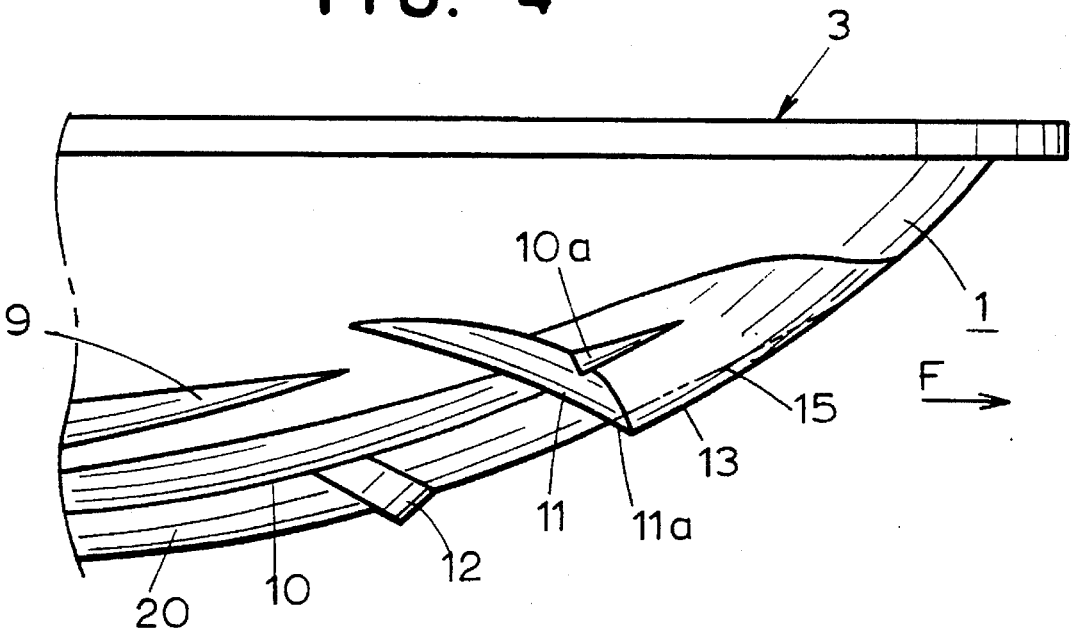
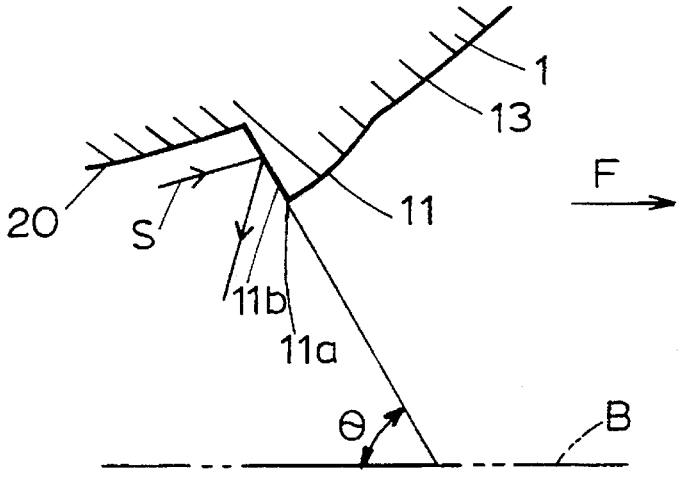
FIG. 5

FIG. 6 PRIOR ART
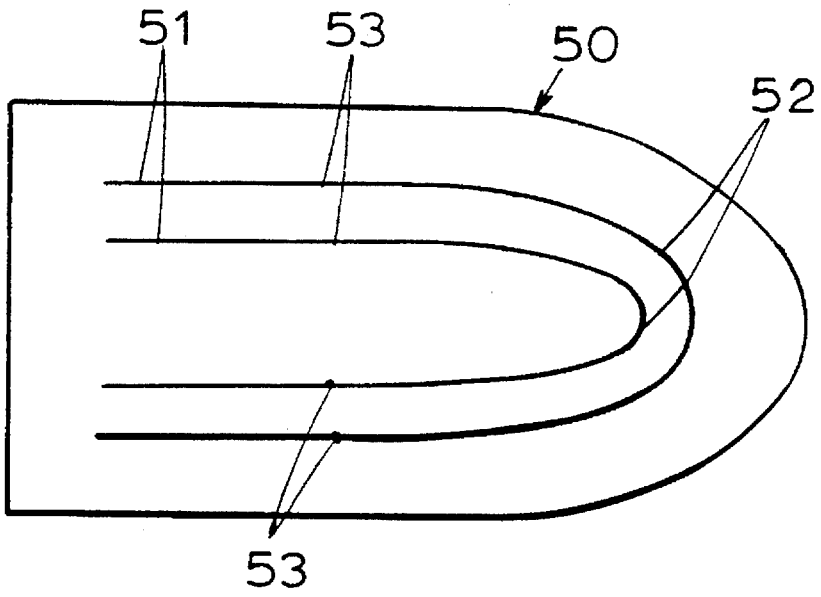
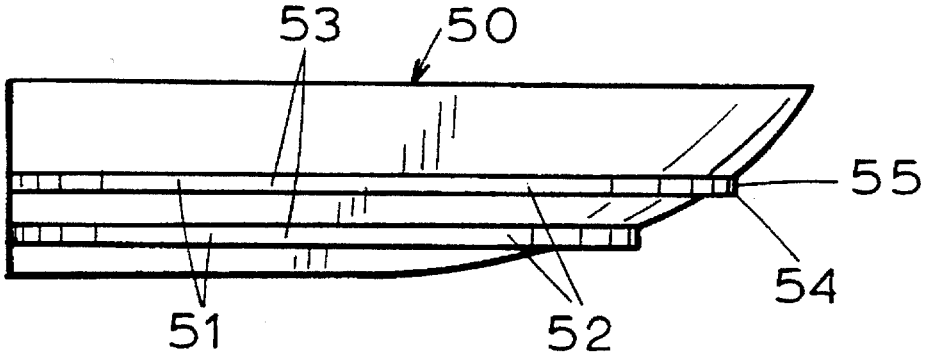
FIG. 7 PRIOR ART

HULL SHAPE OF SMALL WATERCRAFT

TECHNICAL FIELD

The present invention relates to watercraft and more particularly to the hull shape of a small watercraft that provides increased stability and improved course stability.

BACKGROUND OF THE INVENTION

As shown in the bottom plan view of FIG. 6, a small watercraft of the prior art has a hull 50 on whose bottom surface there is provided a plurality of longitudinal chines 51 protruding from the hull bottom surface and extending in a longitudinal direction from the aft toward the fore part of the hull 50. A plurality of backwardly curved transverse chines 52 also protrude from the hull bottom surface and extend in transverse directions at the fore part of the hull 50, and are formed in a smoothly continuous fashion from the respective longitudinal chines 51 (see Japanese Patent Provisional Publication No. 62-34897).

The protruding longitudinal chines 51 prevent the hull 50 from sliding sideways when planing across water, and thereby improves its course stability. On the other hand, the protruding transverse chines 52 prevent the water through which the hull 50 is thrusting from being scattered forward and splashed on the occupants of the craft. Furthermore, when the hull 50 is subjected to a pitching motion, the transverse chines 52 accept the lift from the water and cause the bow to rise, thereby improving the speed performance.

However, when forming the stripes 51 and 52 in continuous fashion as described above, the transverse ends of each transverse chine 52 need to be smoothly bent backwardly through a large angle. This large angle bend inevitably requires that the junction points 53 between the transverse and the longitudinal chines must be positioned toward the aft part of the hull, with the result that most of the straight portions of the longitudinal chines 51 are located in the aft part.

This reduces the length of the longitudinal chines 51, and hence degrades the course stability of the hull 50. In particular, when the watercraft is turning, a portion of the protruding transverse chines 52 (in most cases, the rearward portion) touches the water, and with this portion acting as resistance to the water, an excessive force is exerted which acts to further turn the watercraft in that direction, and thus good course stability cannot be obtained. Furthermore, when the waves are high, the rearward portion of the transverse chines 52 tends to touch the water even when the craft is moving straight forward, and the resistance to the water thus increases.

Moreover, as shown in FIG. 7, which is an elevational view of the prior art watercraft of FIG. 6, each transverse chine 52 has a protruding edge 54 whose front face 55 is substantially vertical to the water surface. As a result, when the wave strikes this front face 55, a large resistance is produced.

The present invention has been devised in view of the above problems, and it is therefore desired to provide a hull shape of a small watercraft that is effective in preventing the water through which the craft is moving from being splashed on the occupants of the craft, and that can enhance the course keeping ability of the hull, especially when turning, while at the same time, reducing the resistance of the hull to the water.

It is also desired to provide a hull shape of a small watercraft which does not produce large resistance even if waves strike the protruding transverse chines from the forward direction.

SUMMARY OF THE INVENTION

In accordance with the principles of the invention a watercraft hull shape employs a hull bottom which is substantially V-shaped in transverse section and on whose underside a longitudinal chine, extending in a longitudinal direction from the aft part toward the fore part of a hull, and a backwardly curved transverse chine, extending in transverse directions and located in the fore part of the hull, are provided in protruding fashion, the transverse chine being formed in such a manner as to cross the forward part of the longitudinal chine or an imaginary line extended forwardly from the longitudinal chine.

Preferably, the transverse chine is formed outside, i.e., above a water level to which the hull sinks when the watercraft is turning.

Also preferably, a plurality of transverse chines are formed one behind another, each of the transverse chines being made shorter in transverse length than the one situated forward of it, the rearmost transverse chine being the shortest in transverse length.

In accordance with one aspect of the invention, the hull shape employs a hull bottom on whose fore part a backwardly curved transverse chine extending in transverse directions is provided in protruding fashion, and a bulging face smoothly continuing from a portion forward of the transverse chine to a protruding edge of the transverse chine is formed in and near a hull center on the hull bottom.

Preferably, in the hull shape of the present invention, the transverse chine has a rear slope face which is formed in such a manner as to protrude obliquely downward from the hull bottom when viewed perpendicularly to a vertical cross-sectional plane containing a normal to the edge of the transverse chine.

According to the hull shape of the present invention, the longitudinal and transverse chines are formed not in smoothly continuing fashion but in such a manner that the transverse chine crosses the forward part of the longitudinal chine or an imaginary line extended from the longitudinal chine. The transverse chine thus arranged prevents the water through which the craft is moving from being splashed on the occupants of the craft, and further, the straight portion of the longitudinal chine call be made substantially long. With this longitudinal chine, good course stability can be maintained, whether the craft is moving straight forward or is turning.

Furthermore, since the rearward portions of the transverse chine, i.e., the portions near the intersection points with the longitudinal chine, are positioned farther toward the forward end of the hull than the junction points in the prior art, the rearward portions of the transverse chine are less likely to strike the water surface when the craft is moving straight forward through high waves, and thus resistance to the water is decreased.

When the transverse chine is formed outside, i.e., above the water level to which the craft sinks when turning, and since the transverse chine stays above the water level when the craft is turning, the course stability during turning improves. When the hull is provided with a plurality of transverse chines, and when their transverse lengths are made shorter with increasing distance from the forward end of the hull, the transverse chine positioned rearward can be easily made to stay out of the water, and the resistance to the water can be further reduced. Moreover, since the transverse chine positioned rearward is made shorter and the transverse chine positioned forward is made longer in transverse length, the spray being created near the hull center and tending to scatter in the forward direction can be effectively held down by the short and long transverse chines and thus prevented from being splashed on the occupants of the craft.

According to one aspect of the invention, a bulging face that smoothly continues from a portion forward of the transverse chine to the protruding edge thereof is formed in and near the center of the hull bottom where the transverse chine is formed. Accordingly, if the hull is subjected to a pitching motion with waves striking the transverse chine from the forward direction, the bulging face acts to reduce the resistance of the transverse chine to the water, and the speed performance of the craft is maintained at a high level.

Furthermore, when the rear slope face of the transverse chine is so formed as to protrude obliquely downward from the hull bottom when viewed perpendicularly to the vertical cross-sectional plane containing the normal to the edge of the transverse chine, the rear slope face of the transverse chine acts to change the direction of the spray downward.

This increases the lift being exerted upon the hull, while preventing the spray from being splashed on the occupants of the craft.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

FIG. 4 is an enlarged, fragmented side elevational view of the fore part of the hull of the watercraft of FIG. 3;

FIG. 5 is an enlarged cross-sectional view taken along section line V—V in FIG. 3;

FIG. 6 is a bottom plan view of a watercraft hull shape according to the prior art; and FIG. 7 is a side elevational view of the prior art hull shape of FIG. 6.

DETAILED DESCRIPTION

One embodiment of the invention will be described below with reference to the accompanying drawings.

Figure 1:
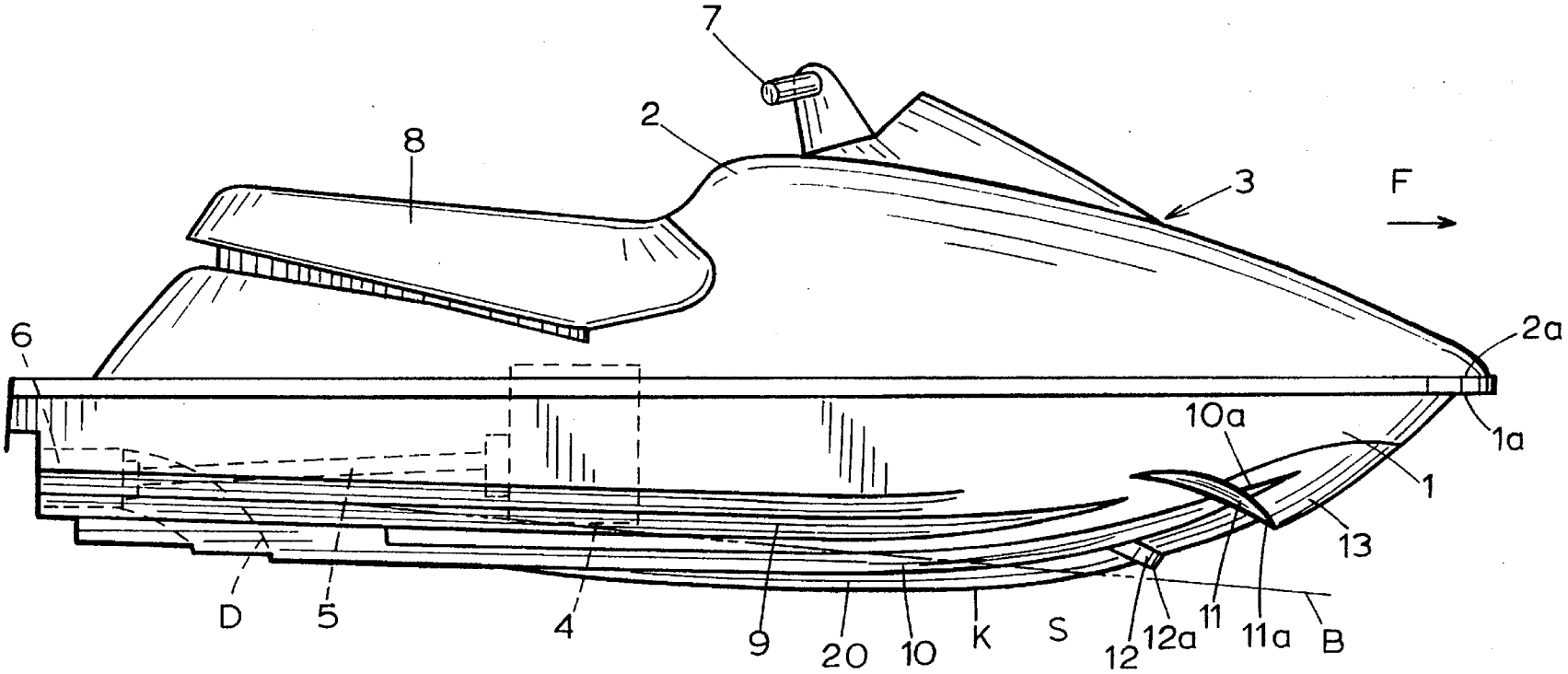
FIG. 1 is a side elevational view showing the hull shape of a small watercraft according to the present invention.

The watercraft shown in FIG. 1 comprises a craft body 3 consisting of a hull 1, a deck 2, an engine 4, and a water-jet propulsor 6 housed in the craft body 3. The water-jet propulsor 6 is driven by a shaft 5 extending from the engine 4. The water-jet propulsor 6 is mounted in a duct D provided in the hull 1. A handle 7 for operating the craft and a seat 8 for accommodating two persons are mounted on the deck 2. The hull 1 has a hull bottom 20 whose transverse cross section is substantially V-shaped, as shown in the front view of FIG. 2. The hull 1 and the deck 2 are formed from synthetic resins and are joined together in integral fashion at flanges 1*a* and 2*a* and at other places not shown, to form the craft body 3.

Figure 3:
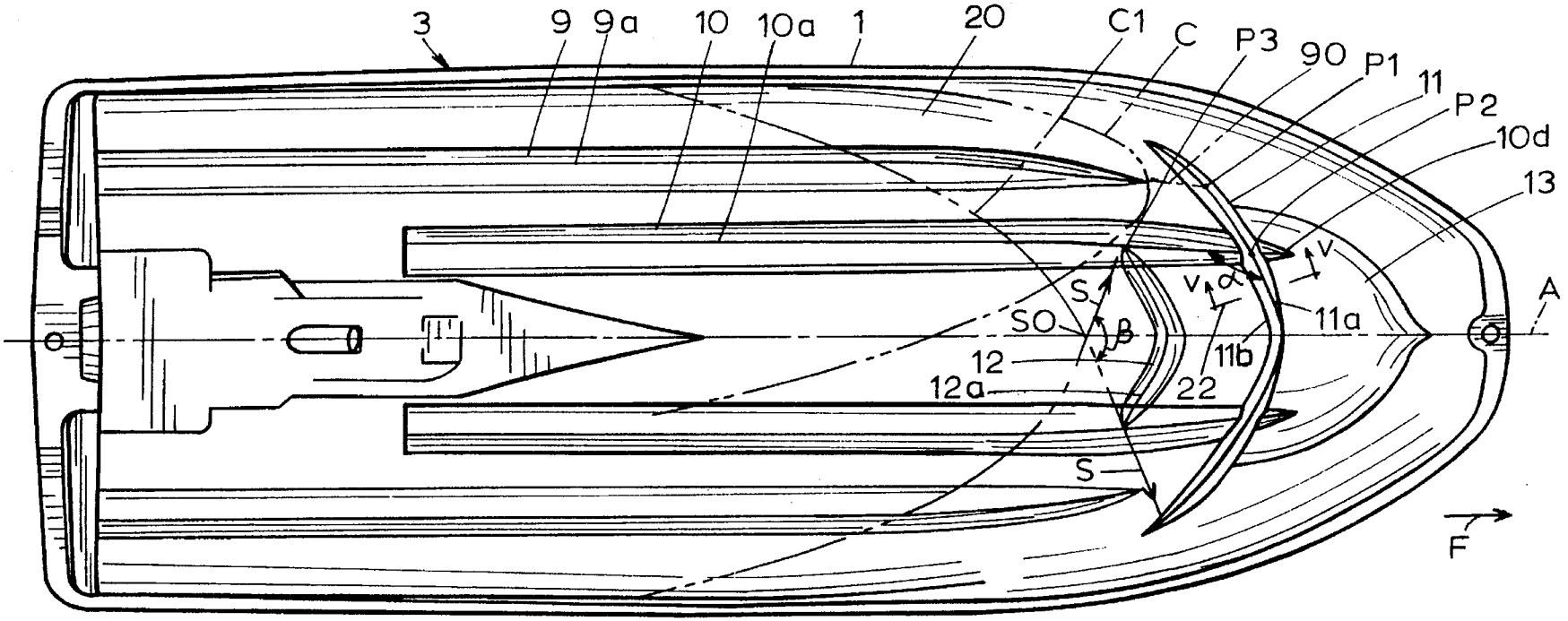
FIG. 3 is a bottom plan view showing the hull bottom of the watercraft of FIG. 1.

On the underside of the hull bottom 20, as shown in the bottom view of FIG. 3, there are formed first and second pairs of longitudinal chines, 9 and 10, protruding downwardly from the hull bottom 20 and extending substantially in parallel with a centerline A running fore and aft of the hull 1, each pair consisting of two chines one pair on each side of the centerline A.

Figure 2:
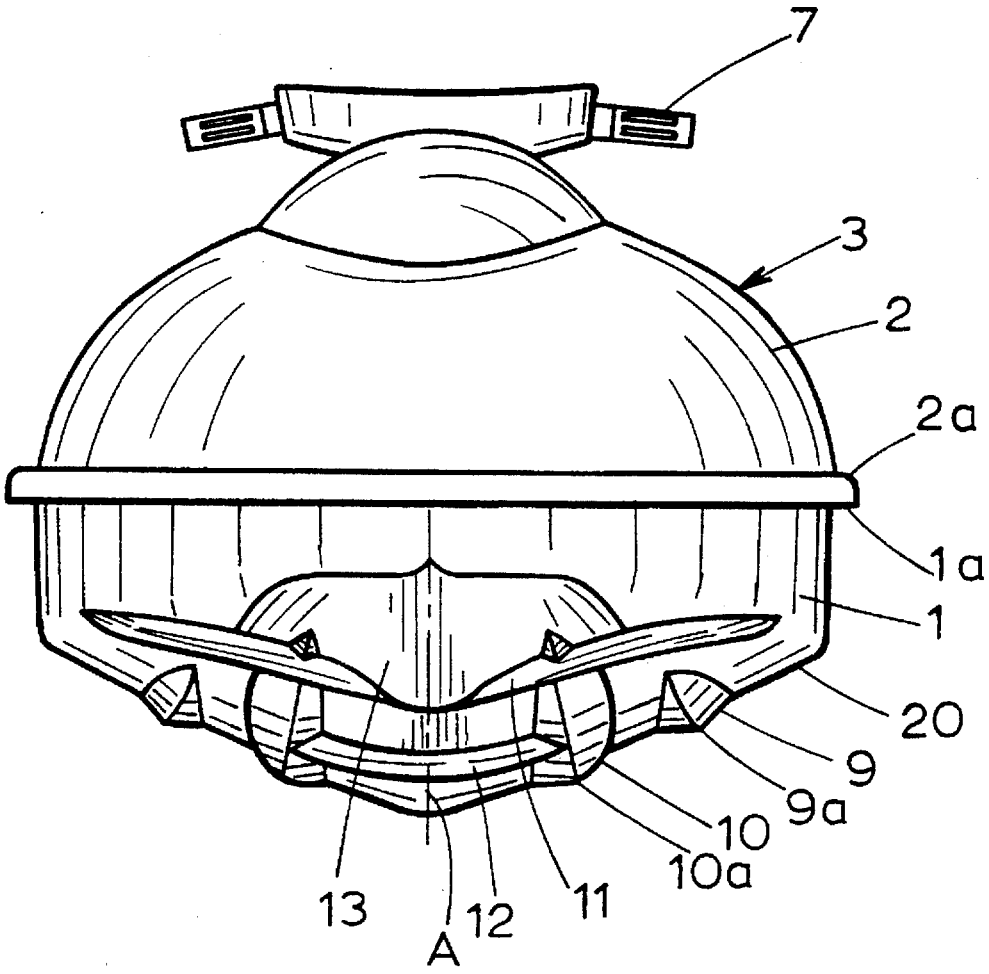
FIG. 2 is a front elevational view of the small watercraft of FIG. 1.

The first longitudinal chines 9 are formed on the transversely opposite sides of the hull 1 and farther apart from the centerline A, and extend from the rear end of the hull 1 toward the fore part thereof. The second longitudinal chines 10 are formed nearer to the centerline A, with their rear ends positioned forward (in the direction of reference arrow F) of the rear ends of the first longitudinal chines 9 and their forward ends also positioned forward of the forward ends of the first longitudinal chines 9. These longitudinal chines 9 and 10 prevent the craft body 3 from sliding sideways when planing across water, and thus ensure good course stability. The first and second longitudinal chines 9 and 10 are substantially triangular in cross section, as shown in FIG. 2.

On the underside of the bottom 20 in the fore part of the hull 1, that is, in the part where the keel line K of the hull 1 of FIG. 1 running along the centerline A rises toward the forward end in the direction F, there is provided a first transverse chine 11 which extends outwardly from the centerline A and is curved backwardly. The ends of the first transverse chine 11 are not joined integrally with the first longitudinal chines 9 but extend beyond the respective forward ends of the first longitudinal chines 9 and toward the gunwales of the craft, while intersecting the forward ends of the second longitudinal chines 10 on the way, as shown in FIG. 3. The first transverse chine 11 crosses imaginary lines 90 extended in the forward direction F from the first longitudinal chines 9. Of course, the first longitudinal chines 9 may be extended further in the forward direction F than shown in the figure so that they actually intersect the first transverse chines 11.

Rearwardly of the first transverse chine 11 and at a lower hull location, there is formed a second transverse chine 12 which extends outwardly from the centerline A and is curved backwardly with its ends crossing the second longitudinal chine 10. The second transverse chine 12 is shorter in transverse length than the first transverse chine 11.

When the points at which the edges 11*a* and 12*a* of the transverse chines 11 and 12 cross the edges 9*a* and 10*a* of the first and second longitudinal chines 9 and 10 are defined as intersection points, it will be noted that the intersection points P1 and P2 between the first transverse chine 11 and the first and second longitudinal chines 9, 10 (P1 is an imaginary point) and the intersection points P3 between the second transverse chine 12 and the second longitudinal chines 10 are all located farther toward the forward end (in the direction F) of the hull than the junction points 53 in the prior art hull construction (FIG. 6). The intersection angles $\alpha$ between the transverse chines 11, 12 and the longitudinal chines 9, 10 are set in the range of 100 to 150 degrees.

As shown in FIG. 1, the second transverse chine 12 is formed so that it is positioned above a water line B, the line above which the craft body 3 stays out of the water when planing across the water. This construction prevents the second transverse chine 12, and hence the first transverse chine 11 positioned at a higher hull location, from striking the water surface when the craft body 3 is planing across the water. This enhances the ability of the longitudinal chines 9 and 10 to keep the craft body 3 in the desired course, thus improving its speed performance.

Since the second transverse chine 12 is positioned rearwardly of the first transverse chine 11 and nearer to the water line B, the second transverse chine 12 can effectively hold down the water through which the craft body is moving and prevent the water from being splashed on the occupants of the craft. If the transverse chine were provided on the hull at a location farther away from the water line and nearer to the forward end, the transverse chine would have to be provided with a much larger vertical protrusion or profile to prevent the water from being scattered forward and splashed on the occupants of the craft. As it is, the second transverse chine 12 is provided close to the water line, and therefore, can effectively prevent the water from being splashed on the occupants of the craft though the amount of protrusion from the hull is small.

The first transverse chine 11, which is provided above the water line B and forward (in the direction of F) of and close to the second transverse chine 12, also serves to prevent the water splashing. Here, as shown in FIG. 3, when the craft is moving straight forward, spray S is created at the forward end of a water level C1 near the center of the craft body, and tends to scatter in the forward direction F. Therefore, when it is assumed that the scattering angle β of the spray S in the horizontal plane remains unchanged, the scattering width of the spray S increases with increasing distance from the spray occurring point SO in the forward direction F. Since the first transverse chine 11, positioned frontward and farther away from the spray occurring point SO, is larger in transverse length than the second transverse chine 12 positioned behind it and nearer to the spray occurring point SO, the spray is effectively held down by the two transverse chines 11 and 12, thus preventing the scattering water from being splashed on the occupants of the craft.

Furthermore, the transverse chines 11 and 12 are both formed outside or above the water level to which the hull 1 sinks when the craft is turning. That is, when the water level to which the hull 1 sinks during the turning of the craft is indicated by C, as shown by an imaginary line in FIG. 3, the transverse chines 11 and 12 are both formed so that they are positioned outside or above the water level C.

Further, as shown in FIG. 4, forwardly (in the direction F) of the first transverse chine 11 and in and near the center of the bottom surface of the hull 1, there is formed a bulging face 13 that continues smoothly from a portion forward of the first transverse chine 11 to the downwardly protruding edge 11*a* thereof. The bottom portion 15 of the hull 1 forward of the first transverse chine 11 is actually formed along the imaginary line shown in FIG. 4, forming a vertical step between the bottom portion 15 of the hull 1 and the edge 11*a* of the transverse chine 11. The bulging face 13 completely covers this vertical step on the hull centerline A, the coverage being reduced at portions located away from the centerline A, as explicitly shown in FIG. 2. This has the effect of drastically reducing the area corresponding to the front face 55 of the transverse chine 52 in the prior art example shown in FIG. 7 thereby reducing the hull resistance.

The shapes of the first and second transverse chines 11 and 12 will be described in detail with reference to FIG. 5 which illustrates the shape of the first transverse chine 11 as a representative example. FIG. 5 is a cross-sectional view taken along a vertical plane containing a normal line 22 to the edge 11*a* of the first transverse chine 11 shown in FIG. 3. As can be seen from the figure, a rear slope face 11*b*, extending rearwardly from the edge 11*a* of the first transverse chine 11, is so formed as to protrude obliquely downward from the hull bottom 20 when viewed perpendicularly to the vertical plane containing the normal line 22. The rear slope face of the second transverse chine 12 is also formed in a similar shape.

The operational effect and resulting advantages of the above construction will now be described.

When the watercraft is planing across water, the first and second longitudinal chines 9 and 10 formed on the underside of the hull 1 of FIG. 1 ensure good course stability, while the first and second transverse chines 11 and 12 prevent the spray S from being scattered in the forward direction F and splashed on the occupants sitting on the seat 8. Further, when the craft body 3 is subjected to a pitching motion, tending to lower the bow, if the transverse chines 11 and 12 are submerged below the water line B, the fore part of the craft body 3 is lifted by the lifting force being exerted by the spray S. This improves the speed performance.

Furthermore, instead of joining the transverse chines to the longitudinal chines in smoothly continuing fashion, as in the prior art, in the embodiment shown in FIG. 3 the transverse chines 11 and 12 are formed in such a manner as to cross the forward ends of the second longitudinal chines 10. Therefore, the straight portion of each of the second longitudinal chines 10 can be made substantially long.

This construction prevents the craft body 3 from sliding sideways when moving straight forward, and thus improves its course stability. Furthermore, when changing the advancing direction of the craft body 3, the longitudinal chines 9 and 10 extending over a substantial distance in the forward direction F stay underwater to prevent the craft from sliding sideways, thus keeping the craft firmly in the desired course.

Moreover, since the intersection points P1–P3 between the transverse chines 11, 12 and the longitudinal chines 9, 10 are positioned toward the forward end F of the craft body, the rearward ends, i.e., the transverse ends, of the transverse chines 11 and 12 are less likely to strike the water surface when the craft is moving straight forward through high waves. This reduces the hull resistance to the water and improves the speed performance of the craft.

Furthermore, since the transverse chines 11 and 12 are both formed outside or above the water level C to which the craft body sinks when turning, the transverse chines 11 and 12 stay above the water when the craft is turning, and the course stability during turning improves.

The first and second transverse chines 11 and 12 are formed in the fore part of the hull bottom 20, the second transverse chine 12 positioned rearward being made shorter than the first transverse chine 11 positioned frontward.

This arrangement makes it easier to keep the second transverse chine 12 above the water level C during turning, and the hull resistance to the water is thus reduced.

Furthermore, the bulging face 13 that smoothly continues from a portion forward of the first transverse chine 11 to the protruding edge 11*a* thereof is formed in and near the center of the hull bottom 20 where the first transverse chine 11 is formed, as shown in FIG. 1. Accordingly, if the craft body 3 is subjected to a pitching motion with waves striking the first transverse chine 11 from the forward direction, the bulging face 13 acts to decrease the resistance of the first transverse chine to the water, so that the speed performance of the craft can be maintained.

Moreover, since the rear slope face 11*b* of the first transverse chine 11 shown in FIG. 5 is so formed as to protrude obliquely downward when viewed perpendicularly to the vertical cross-sectional plane containing the normal line 22 to the edge 11*a* of the transverse chine 11 (see FIG. 3), the rear slope face 11*b* of the transverse chine 11 acts to change the direction of the spray S downward, thereby preventing the spray S from splashing on the occupants of the craft. Furthermore, since the lifting force being exerted on the craft body 3 by the spray S is increased, a greater force is provided to lift the bow when the bow attempts to become lower due to the pitching of the craft body 3.

To hold down the spray S and to increase the bow lifting force, it is desirable that the angle θ of the rear slope face 11*b* of the first transverse chine 11 with respect to the water line B (see FIG. 5), when the craft is moving straight forward, be set within the range of 20 to 70 degrees, and more preferably within the range of 25 to 60 degrees. Further, since the rear slope face of the second transverse chine 12 is also formed in a similar shape and therefore offers a similar effect, it is desirable that the angle of the rear slope face of the second transverse chine 12 be set at a similar angle.

In the above embodiment, the first and second longitudinal chines 9 and 10 are formed in pairs, each consisting of two chines one on each side of the centerline A. Alternatively, only one pair of longitudinal chines may be provided, one on each side of the centerline A, or three or more pairs of longitudinal chines may be provided.

Also, the number of transverse chines is not limited to two, but only one transverse chine or three or more transverse chines may be provided. When providing three or more transverse chines, the chines should be made shorter in transverse length with decreasing distance from the rear section of the hull 1 so that the chines can be kept out of the water when the craft is turning.

Each of the second longitudinal chines 10 shown in FIG. 3 is formed with its forward protruding end portion 10*d* protruding beyond the end of the first transverse chine 11 in the forward direction F, but this protruding end portion 10*d* need not necessarily be provided.

The foregoing detailed description has been given for clearness of understanding only, and no unnecessary limitations should be understood therefrom, as modifications will be obvious to those skilled in the art.

What is claimed is:

1. A hull shape of a small watercraft comprising a hull bottom which is substantially V-shaped in transverse section and on whose underside at least one longitudinal chine, extending in a longitudinal direction from the aft part toward the fore part of a hull, and at least one backwardly curved unitary transverse chine, continuously extending in transverse directions substantially across the fore part of said hull, are provided protruding from said hull bottom, and wherein said unitary transverse chine is formed in such a manner as to cross one of (a) the forward part of said longitudinal chine and (b) an imaginary line extended forwardly from said longitudinal chine.

2. The hull shape of a small watercraft according to claim 1, wherein said unitary transverse chine is formed above a water level to which said hull sinks when said watercraft is turning.

3. The hull shape of a small watercraft according to claim 1, wherein a plurality of unitary transverse chines are formed one behind another, each of said unitary transverse chines being made shorter in transverse length than the one situated forward of it, the rearmost unitary transverse chine being the shortest in transverse length.

4. The hull shape of a small watercraft according to claim 2, wherein a plurality of unitary transverse chines are formed one behind another, each of said unitary transverse chines being made shorter in transverse length than the one situated forward of it, the rearmost unitary transverse chine being the shortest in transverse length.

5. The hull shape of a small watercraft according to claim 1, wherein said unitary transverse chine has a rear slope face which is formed in such a manner as to protrude obliquely downward from said hull bottom when viewed perpendicularly to a vertical cross-sectional plane containing a normal line perpendicular to the edge of said unitary transverse chine.

6. A hull shape of a small watercraft comprising a hull bottom on whose fore part a backwardly curved transverse chine extending in transverse directions is provided protruding from said hull bottom, and wherein a bulging face smoothly continuing from a portion forward of said transverse chine to a protruding edge of said transverse chine is formed in and near the hull center on said hull bottom.

7. The hull shape of a small watercraft according to claim 6, wherein said transverse chine has a rear slope face which is formed in such a manner as to protrude obliquely downward from said hull bottom when viewed perpendicularly to a vertical cross-sectional plane containing a normal line perpendicular to the edge of said transverse chine.

8. A hull shape of a small watercraft comprising a hull bottom which is substantially V-shaped in transverse section and on whose underside at least one longitudinal chine, extending in a longitudinal direction from the aft part toward the fore part of a hull, and at least one backwardly curved transverse chine, extending in transverse directions substantially across the fore part of said hull, are provided protruding from said hull bottom, wherein said transverse chine is formed in such a manner as to cross one of (a) the forward part of said longitudinal chine and (b) an imaginary line extended forwardly from said longitudinal chine, and wherein said transverse chine has a rear slope face which is formed in such a manner as to protrude obliquely downward from said hull bottom when viewed perpendicularly to a vertical cross-sectional plane containing a normal line perpendicular to the edge of said transverse chine.

9. The hull shape of a small watercraft according to claim 8, wherein said transverse chine is formed above a water level to which said hull sinks when said watercraft is turning.

10. The hull shape of a small watercraft according to claim 8, wherein a plurality of transverse chines are formed one behind another, each of said transverse chines being made shorter in transverse length than the one situated forward of it, the rearmost transverse chine being the shortest in transverse length.

11. The hull shape of a small watercraft according to claim 9, wherein a plurality of transverse chines are formed one behind another, each of said transverse chines being made shorter in transverse length than the one situated forward of it, the rearmost transverse chine being the shortest in transverse length.

12. A hull shape of a small watercraft comprising a hull bottom which is substantially V-shaped in transverse section and on whose underside at least one longitudinal chine, extending in a longitudinal direction from the aft part toward the fore part of a hull, and at least one backwardly curved transverse chine, extending in transverse directions between opposite transverse chine ends substantially across the fore part of said hull, are provided protruding from said hull bottom, said transverse chine ends are confined to the fore part of said hull with the ends of the transverse chine separate from the longitudinal chine, and wherein said transverse chine is formed in such a manner as to cross an imaginary line extended forwardly from said longitudinal chine.

13. The hull shape of a small watercraft according to claim 12, wherein the transverse dimension of said transverse chine between its opposite ends is greater than the longitudinal dimension of said transverse chine between its opposite ends.

* * * * *